US008026441B2

(12) United States Patent
Amato

(10) Patent No.: US 8,026,441 B2
(45) Date of Patent: Sep. 27, 2011

(54) COAXIAL CABLE SHIELDING

(75) Inventor: Alan John Amato, Cheshire, CT (US)

(73) Assignee: John Mezzalingua Associates, Inc., E. Syracuse, NY (US)

( * ) Notice: Subject to any disclaimer, the term of this patent is extended or adjusted under 35 U.S.C. 154(b) by 112 days.

(21) Appl. No.: 12/432,539

(22) Filed: Apr. 29, 2009

(65) Prior Publication Data

US 2010/0276176 A1 Nov. 4, 2010

(51) Int. Cl.
*H01B 11/06* (2006.01)

(52) U.S. Cl. ..... 174/28; 174/36; 174/102 R

(58) Field of Classification Search ..... 174/28, 174/36, 102 R, 106 R
See application file for complete search history.

(56) References Cited

U.S. PATENT DOCUMENTS

| | | | | |
|---|---|---|---|---|
| 3,304,214 | A | 2/1967 | Alm | |
| 3,662,090 | A | 5/1972 | Grey | |
| 3,785,048 | A | 1/1974 | Petersen | |
| 3,798,350 | A | 3/1974 | Clarke | |
| 4,406,914 | A | 9/1983 | Kincaid | |
| 4,510,346 | A * | 4/1985 | Bursh et al. | 174/36 |
| 4,647,720 | A | 3/1987 | Vokey | |
| 4,984,357 | A | 1/1991 | Pan | |
| 5,018,268 | A | 5/1991 | Chabane et al. | |
| 5,023,395 | A * | 6/1991 | O'Connor | 174/36 |
| 5,039,197 | A | 8/1991 | Rawlyk | |
| 5,261,021 | A | 11/1993 | Pasta et al. | |
| 5,367,123 | A * | 11/1994 | Plummer et al. | 174/36 |
| 5,949,018 | A * | 9/1999 | Esker | 174/23 R |
| 2004/0154823 | A1* | 8/2004 | Amato | 174/113 R |

FOREIGN PATENT DOCUMENTS

| | | | |
|---|---|---|---|
| JP | 2002352639 | A | 12/2002 |
| JP | 2004220798 | A | 8/2004 |
| JP | 2004259599 | A | 9/2004 |

OTHER PUBLICATIONS

PCT/US2010/032280, International Filing Date: Apr. 23, 2010. International Search Report and Written Opinion. Date of Mailing: Nov. 19, 2010. 9 pages.

* cited by examiner

*Primary Examiner* — Chau N Nguyen
(74) *Attorney, Agent, or Firm* — Schmeiser, Olsen & Watts, LLP

(57) ABSTRACT

Coaxial cable shielding. In one example embodiment, a coaxial cable includes a center conductor, a dielectric, a tape, and a jacket. The tape defines first and second edge portions that each borders an interior portion. The thickness of the first edge portion is less than the thickness of the interior portion. The dielectric surrounds the center conductor. The tape is wrapped around the dielectric such that the first edge portion overlaps with the second edge portion. The jacket surrounds the tape.

16 Claims, 16 Drawing Sheets

COAXIAL CABLE SHIELDING

BACKGROUND

Typical coaxial cable includes radio frequency (RF) shielding. One common type of shielding is a conductive tape that attenuates interfering electromagnetic fields in the high frequency range.

With reference first to FIG. 1A, a prior art coaxial cable 100 is disclosed. As disclosed in FIG. 1A, the coaxial cable 100 is terminated on either end with connectors 150. With reference now to FIG. 1B, the prior art coaxial cable 100 generally includes a center conductor 102 surrounded by a dielectric 104, a tape 106 wrapped longitudinally around the dielectric, a braid 108 surrounding the tape 106, and a jacket 10 surrounding the braid 108.

With reference now to FIG. 1C, the tape 106 surrounds the dielectric 104, and generally serves to limit the ingress and egress of high frequency electromagnetic fields 126 to/from the center conductor 102. The tape 106 is a laminate tape that includes a first aluminum layer 112, a polymer layer 114, a second aluminum layer 116, and a polymer bonding agent layer 118. The tape 106 also defines a first edge portion 120 that overlaps a second edge portion 124 as the tape 106 is longitudinally wrapped around the longitudinal direction of the dielectric 104, resulting in an overlapping seam that runs parallel to the center conductor 102.

With continuing reference to FIG. 1C, and with reference also to FIG. 1D, a common problem with the tape 106 of the prior art coaxial cable 100 is disclosed. In particular, although the first and second aluminum layers 112 and 116 are generally effective at shielding high frequency electromagnetic fields 126 above the frequency for one skin depth, since the polymer layer 114 and the polymer bonding agent layer 118 are formed from dielectric materials, the layers 114 and 118 are not effective at shielding electromagnetic fields 126. As a result, some high frequency electromagnetic fields 126 from the center conductor 102, such as electromagnetic fields greater than about 50 MHz, exit the prior art coaxial cable 100 by traveling through an overlap aperture 128 of the polymer bonding agent layer 118.

Similarly, although the second aluminum layer 116 is generally effective at shielding electromagnetic fields 126 above the frequency for one skin depth, some fraction of the high frequency electromagnetic fields 126 from the center conductor 102 do pass through the second aluminum layer 116. This results in some high frequency electromagnetic fields 126 from the center conductor 102 exiting the prior art coaxial cable 100 by traveling through an overlap aperture 130 of the polymer layer 114. These high frequency electromagnetic fields 126 that exit the prior art coaxial cable 100 cause harmful interference with surrounding electrical equipment (not shown). Some high frequency electromagnetic fields from surrounding electrical equipment (not shown) also enter the prior art coaxial cable 100 through the overlap apertures 128 and 130, thus causing harmful interference with data signals that are traveling through the center conductor 102.

With reference now to FIG. 1E, another prior art coaxial cable 100' is disclosed. The coaxial cable 100' is identical to the coaxial cable 100 except that the coaxial cable 100' includes a helically wrapped tape 106'. As disclosed in FIG. 1E, the tape 106' also defines a first edge portion that overlaps a second edge portion as the tape 106' is helically wrapped around the dielectric 104, resulting in an overlapping seam that runs in a spiral configuration around the dielectric 104. As with the tape 106, the tape 106' allows some high frequency electromagnetic fields to enter/exit the coaxial cable 100' by traveling through one or more overlap apertures. These high frequency electromagnetic fields cause harmful interference with surrounding electrical equipment (not shown) and with data signals that are traveling through the center conductor 102.

SUMMARY OF SOME EXAMPLE EMBODIMENTS

In general, example embodiments of the present invention relate to coaxial cable shielding. Some example embodiments reduce or eliminate overlap apertures at overlapping edges of a tape during the manufacturing of a coaxial cable. In coaxial cable, this reduction or elimination of overlap apertures results in an increase in the uniformity of the shielding of interfering high frequency electromagnetic fields.

In one example embodiment, a coaxial cable includes a center conductor, a dielectric, a tape, and a jacket. The tape defines first and second edge portions that each borders an interior portion. The thickness of the first edge portion is less than the thickness of the interior portion. The dielectric surrounds the center conductor. The tape is wrapped around the dielectric such that the first edge portion overlaps with the second edge portion. The jacket surrounds the tape.

In another example embodiment, a method for manufacturing a coaxial cable includes various steps. The cable includes a tape that defines first and second edge portions that each borders an interior portion. First, the first edge portion is compressed such that the thickness of the first edge portion is less than the thickness of the interior portion. Next, the tape is longitudinally wrapped around a dielectric that surrounds a center conductor such that the first edge portion overlaps with the second edge portion. Finally, the tape is surrounded with a jacket.

In yet another example embodiment, a method for manufacturing a coaxial cable includes various steps. First, a dielectric is extruded around a center conductor. Next, a tape, which defines first and second edge portions that each borders an interior portion, is heated and passed through a pair of rollers in order to compress the first and second edge portions, respectively, such that the thickness of each of the first and second edge portions is less than the thickness of the interior portion. Then, the tape is longitudinally wrapped around the dielectric such that the first and second edge portions overlap one another. Next, the tape is surrounded with a braid. Finally, a jacket is extruded around the braid.

This Summary is provided to introduce a selection of concepts in a simplified form that are further described below in the Detailed Description. This Summary is not intended to identify key features or essential characteristics of the claimed subject matter, nor is it intended to be used as an aid in determining the scope of the claimed subject matter. Moreover, it is to be understood that both the foregoing general description and the following detailed description of the present invention are exemplary and explanatory and are intended to provide further explanation of the invention as claimed.

BRIEF DESCRIPTION OF THE DRAWINGS

Aspects of example embodiments of the present invention will become apparent from the following detailed description of example embodiments given in conjunction with the accompanying drawings, in which.

DETAILED DESCRIPTION OF SOME EXAMPLE EMBODIMENTS

Example embodiments of the present invention relate to coaxial cable shielding. In the following detailed description of some example embodiments, reference will now be made in detail to specific embodiments of the present invention, examples of which are illustrated in the accompanying drawings. Wherever possible, the same reference numbers will be used throughout the drawings to refer to the same or like parts. These embodiments are described in sufficient detail to enable those skilled in the art to practice the invention. Other embodiments may be utilized and structural, logical and electrical changes may be made without departing from the scope of the present invention. Moreover, it is to be understood that the various embodiments of the invention, although different, are not necessarily mutually exclusive. For example, a particular feature, structure, or characteristic described in one embodiment may be included within other embodiments. The following detailed description is, therefore, not to be taken in a limiting sense, and the scope of the present invention is defined only by the appended claims, along with the full scope of equivalents to which such claims are entitled.

I. First Example Coaxial Cable

Figure 2A:
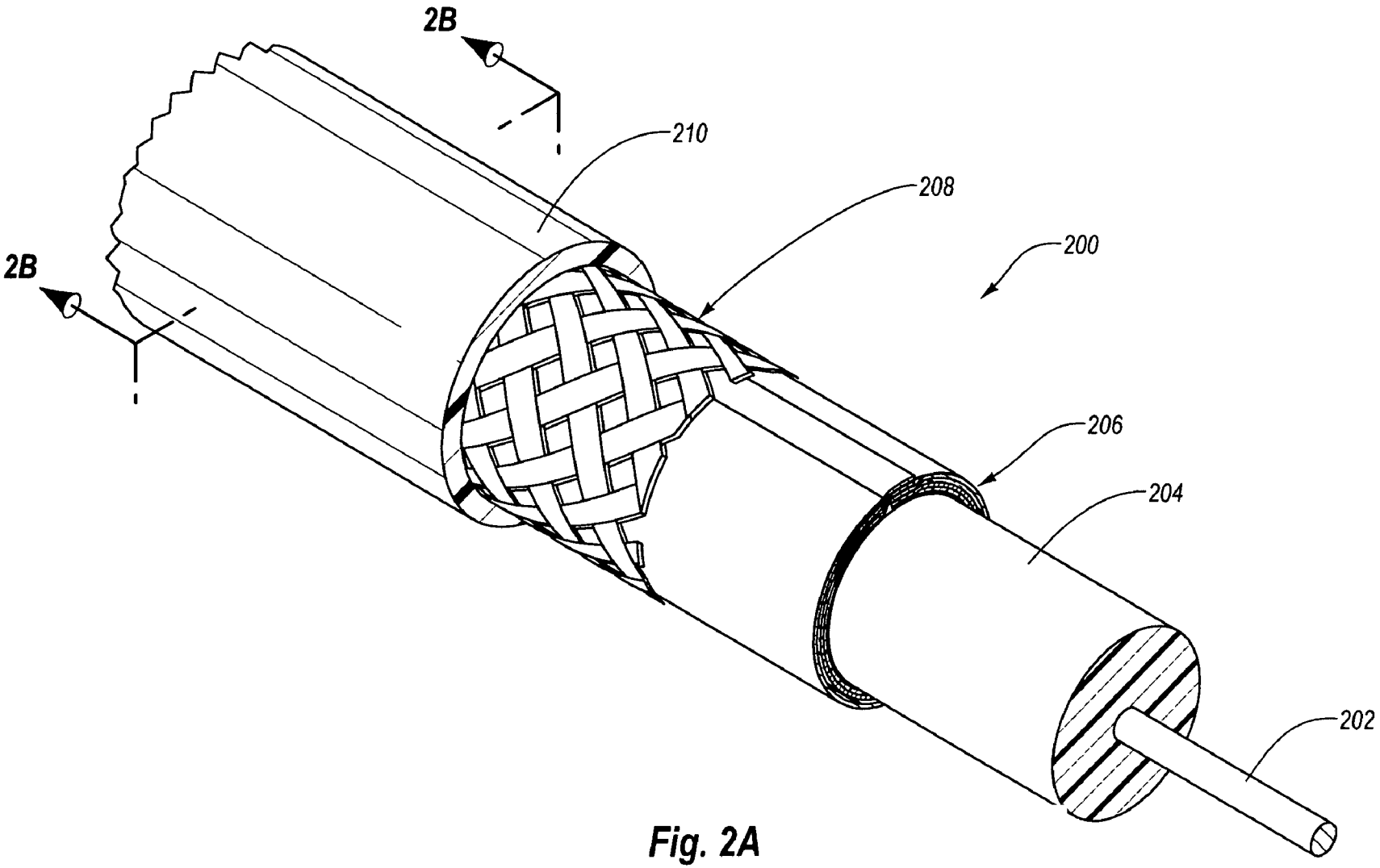
FIG. 2A is a perspective view of a portion of a first example coaxial cable with an example compressed tape layer, the perspective view having portions of each layer of the example coaxial cable cut away.

With reference now to FIG. 2A, a first example coaxial cable 200 is disclosed. The example coaxial cable 200 can be any type of coaxial cable including, but not limited to, 50 Ohm and 75 Ohm coaxial cable. The coaxial cable 200 generally includes a center conductor 202 surrounded by a dielectric 204, a tape 206 wrapped longitudinally around the dielectric, a braid 208 surrounding the tape 206, and a jacket 210 surrounding the braid 208. As used herein, the phrase "surrounded by" refers to an inner layer generally being encased by an outer layer. However, it is understood that an inner layer may be "surrounded by" an outer layer without the inner layer being immediately adjacent to the outer layer. The term "surrounded by" thus allows for the possibility of intervening layers. Each of these components of the example coaxial cable 200 will now be discussed in turn.

The center conductor 202 is positioned at the core of the example coaxial cable 200. The center conductor 202 can be configured to carry a range of electrical current (amperes) as well as an RF/electronic digital signal. In some example embodiments, the center conductor 202 is formed from solid copper, copper-clad aluminum (CCA), copper-clad steel (CCS), or silver-coated copper-clad steel (SCCCS), although other conductive materials are possible. For example, the center conductor 202 can be formed from any type of conductive metal or alloy. In addition, the center conductor 202 can be solid, hollow, stranded, corrugated, plated, or clad, for example.

The dielectric 204 surrounds the center conductor 202, and generally serves to support and insulate the center conductor 202 and the tape 206. Although not shown in the figures, a bonding agent, such as a polymer, may be employed to bond the dielectric 204 to the center conductor 202. In some example embodiments, the dielectric 204 can be, but is not limited to, taped, solid, or foamed polymer or fluoropolymer. For example, the dielectric 204 can be foamed polyethylene (PE).

The tape 206 surrounds the dielectric 204, and generally serves to minimize the ingress and egress of high frequency electromagnetic fields to/from the center conductor 202. In some applications, high frequency electromagnetic fields are fields that are greater than or equal to about 50 MHz.

Figure 2B:
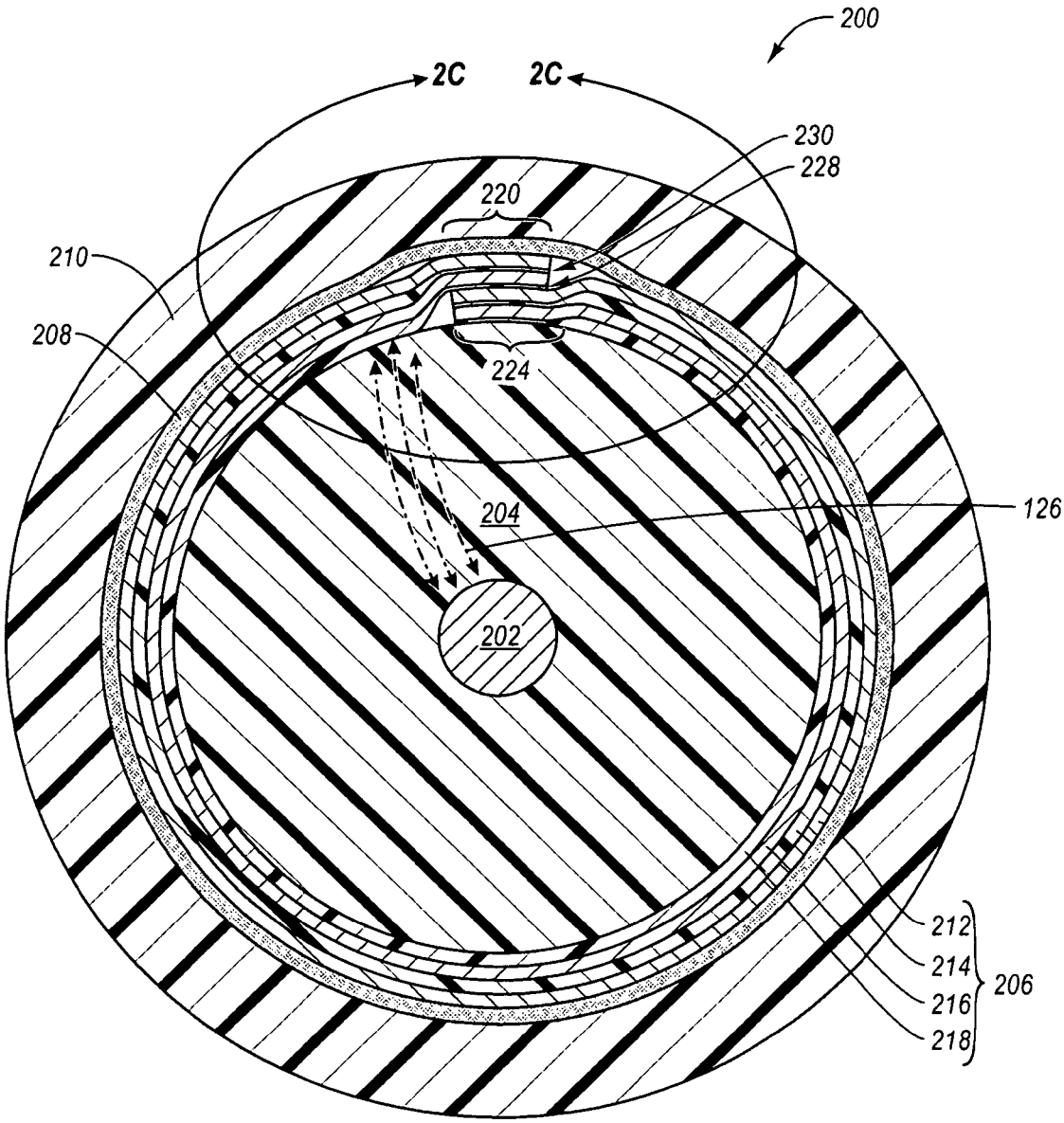
FIG. 2B is a cross-sectional view of the example coaxial cable of FIG. 2A.
Figure 2C:
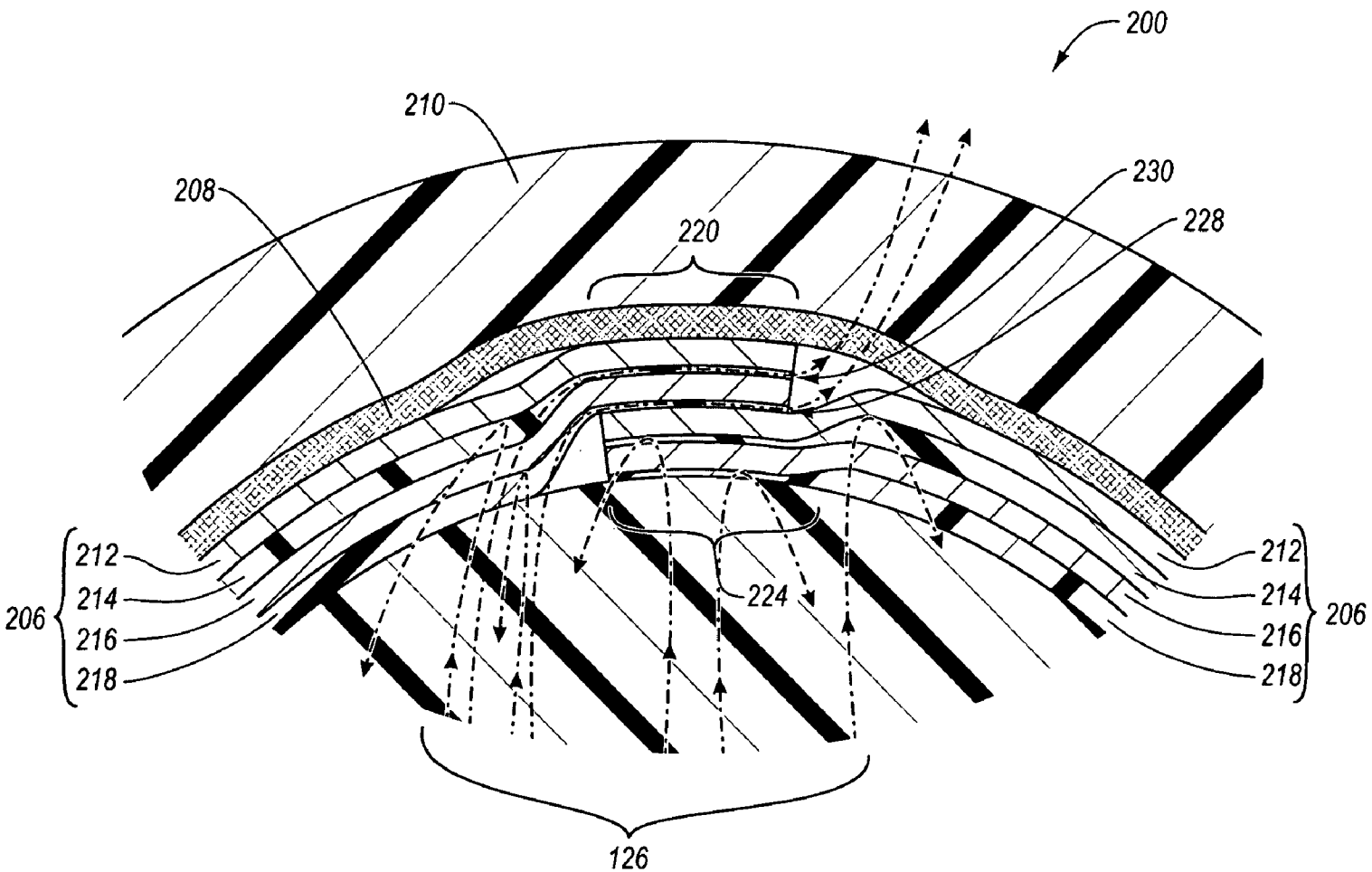
FIG. 2C is an enlarged view of a portion of the cross-sectional view of FIG. 2B.

With reference now to FIGS. 2B and 2C, the tape 206 is a laminate tape that includes a first aluminum layer 212, a polymer layer 214, a second aluminum layer 216, and a polymer bonding agent layer 218. It is understood, however, that the discussion herein of the tape 206 is not limited to tape having any particular combinations of layers. For example, the tape 206 can instead include, but is not limited to, the following layers: copper/polymer/polymer bonding agent, aluminum/polymer/polymer bonding agent, aluminum/polymer, or aluminum/polymer/aluminum.

Figure 2D:
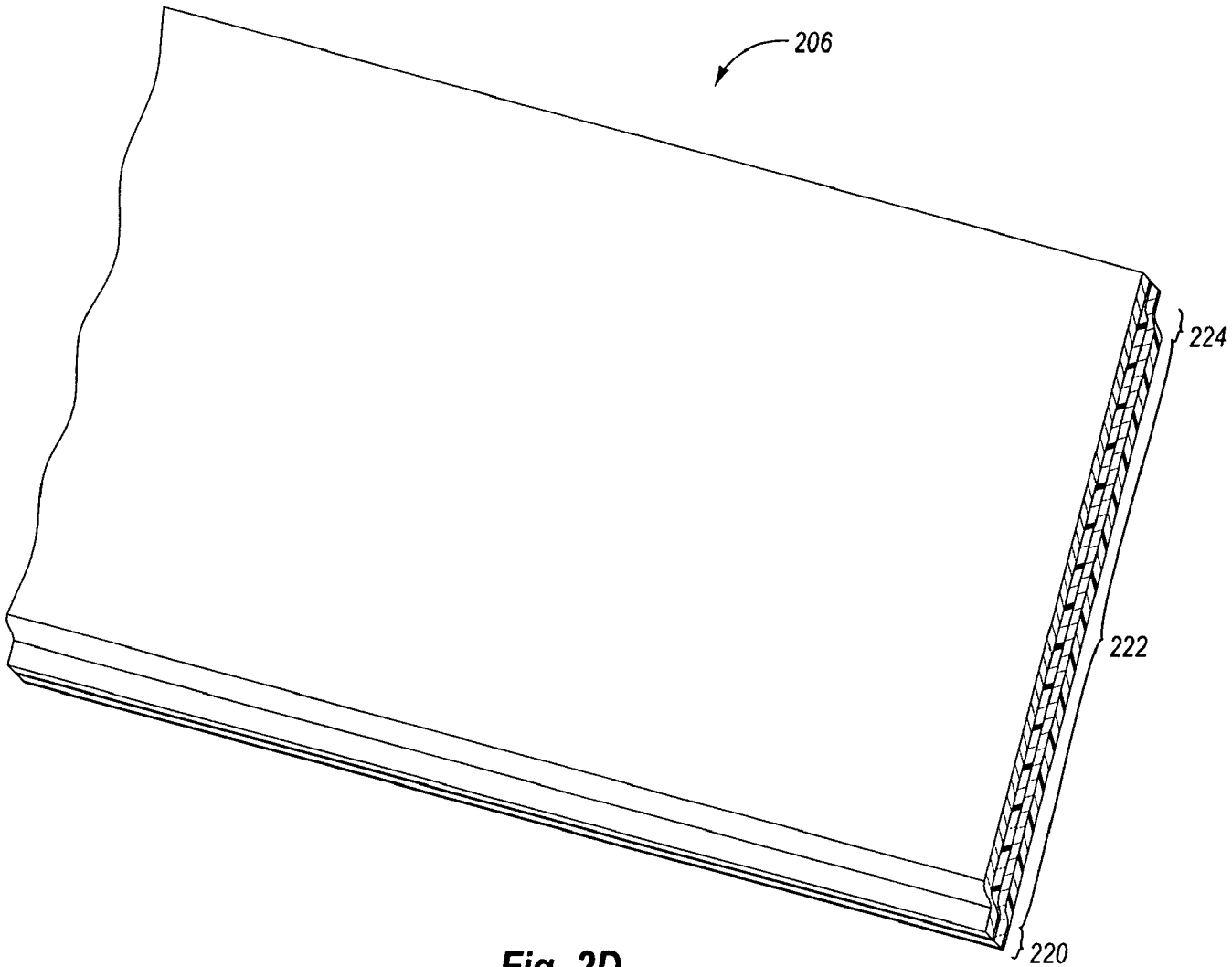
FIG. 2D is a perspective view of a section the example compressed tape of FIGS. 2A-2C prior to the inclusion of the example compressed tape as a layer of the example coaxial cable of FIGS. 2A-2C.
Figure 2E:
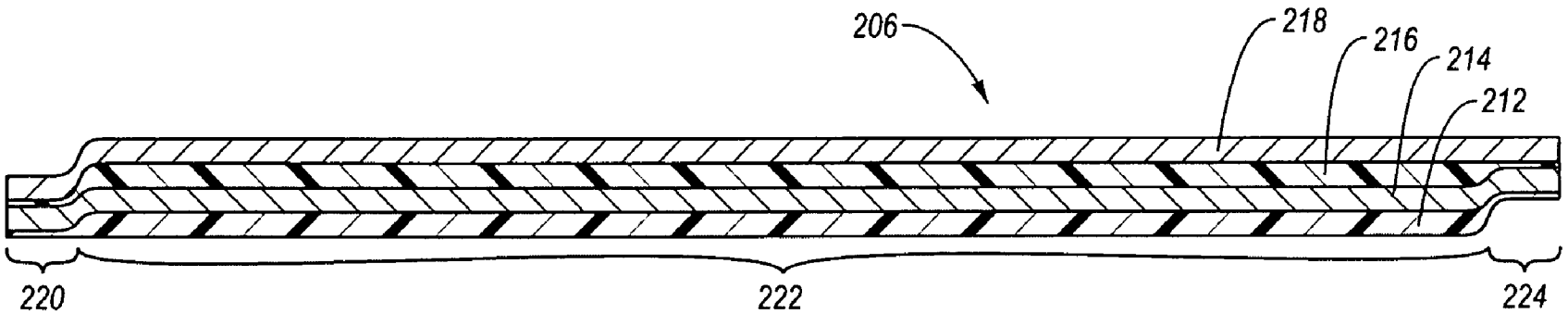
FIG. 2E is a cross-sectional view of the example compressed tape of FIG. 2D.

With reference now to FIGS. 2D and 2E, the tape 206 defines first and second edge portions 220 and 224 that each borders an interior portion 222. As disclosed in FIGS. 2D and 2E, prior to the tape 206 being wrapped around the dielectric 204, each of the exterior edge portions 220 and 224 is compressed so that the thickness of each of the exterior edge portions 220 and 224 is less than the thickness of the interior portion 222. More particularly, as disclosed in FIG. 2E, the relative thinness of each of the edge portions 220 and 224 as compared to the interior portion 222 can generally be attributed to the compression of the polymer layer 214 and the polymer bonding agent layer 218 in the edge portions 220 and 224.

With reference again to FIGS. 2B and 2C, as the tape 206 is longitudinally wrapped around the longitudinal direction of the dielectric 204, the first edge portion 220 overlaps with the second edge portion 224. As the polymer layer 214 and the polymer bonding agent layer 218 are each dielectric layers, and thus are not effective at shielding interfering electromagnetic fields, the compression of the polymer layer 214 and the polymer bonding agent layer 218 in the edge portions 220 and 224 reduces the size of, or eliminates entirely, typical overlap apertures in the tape 206.

Figure 1A:
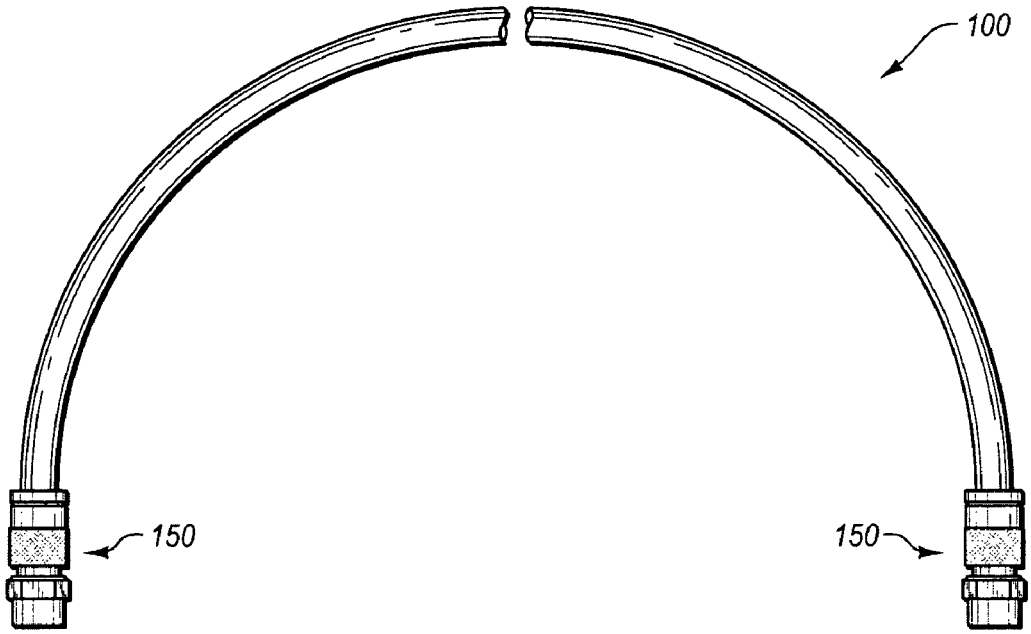
Fig. 1A (Prior Art)
FIG. 1A is a perspective view of a prior art example coaxial cable terminated with two example connectors.
Figure 1B:
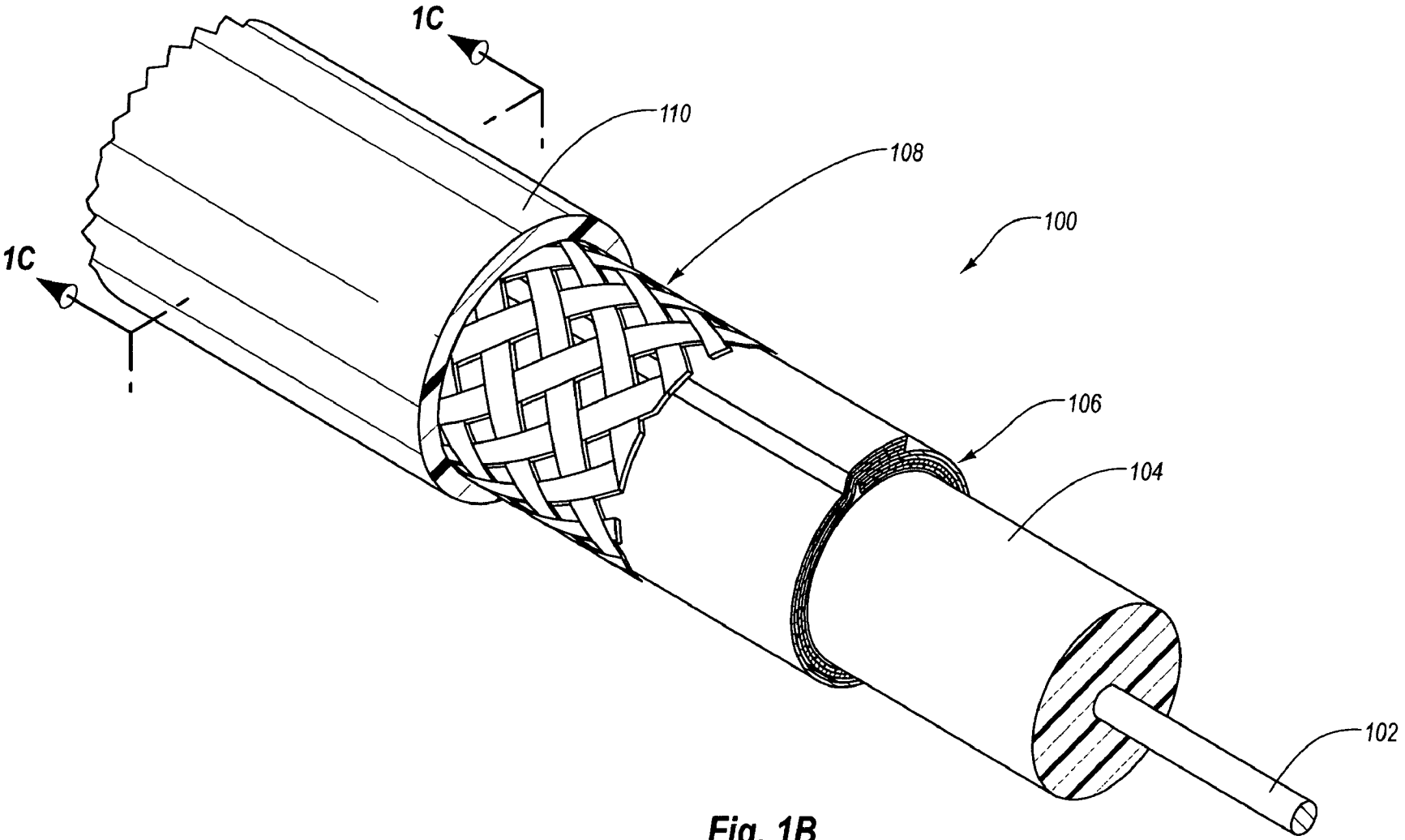
Fig. 1B (Prior Art)
FIG. 1B is a perspective view of a portion of the prior art coaxial cable of FIG. 1A, the perspective view having portions of each layer of the prior art coaxial cable cut away.
Figure 1C:
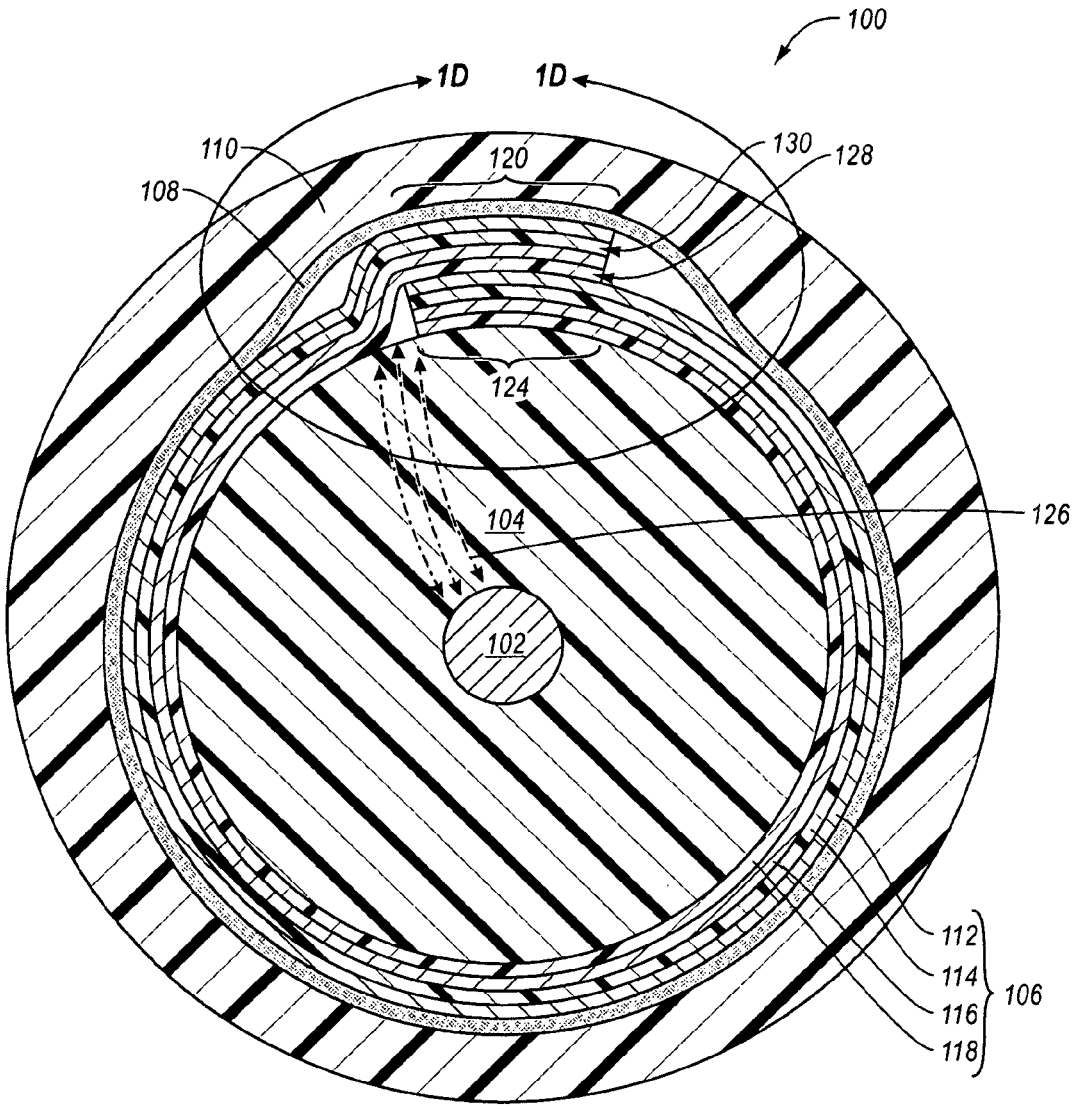
Fig. 1C (Prior Art)
FIG. 1C is a cross-sectional view of the prior art coaxial cable of FIG. 1B.
Figure 1D:
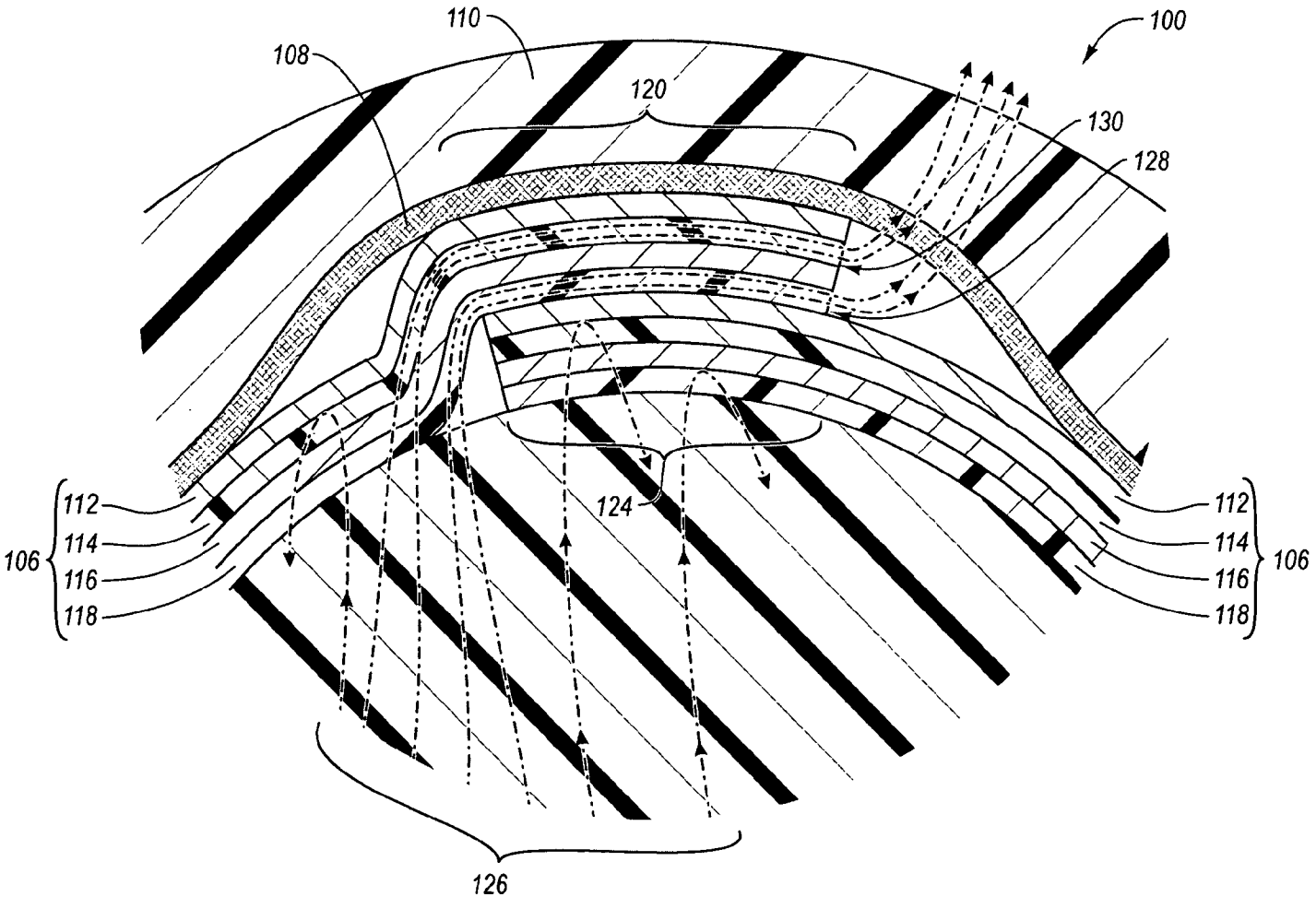
Fig. 1D (Prior Art)
FIG. 1D is an enlarged view of a portion of the cross-sectional view of FIG. 1C.

For example, compared to the overlap aperture 128 of FIG. 1D, the overlap aperture 228 of the polymer bonding agent layer 218 of FIG. 2C is substantially reduced in size. As a result, fewer high frequency electromagnetic fields 126 from the center conductor 202 exit the example coaxial cable 200 through the overlap aperture 228 than exit the prior art coaxial cable 100 through overlap aperture 128 (compare FIGS. 1D and 2C). This reduction of escaping high frequency electromagnetic fields 126 is illustrated in FIG. 2C with only a single high frequency electromagnetic field 126 escaping through the overlap aperture 228, whereas in FIG. 1D two high frequency electromagnetic fields 126 escape through the overlap aperture 128. This illustration is for example purposes only, and is not intended to limit this embodiment to a reduction of 50% in escaping high frequency electromagnetic fields 126, as this embodiment also encompasses reductions that are greater than and less than 50%.

Similarly, compared to the overlap aperture 130 of FIG. 1D, the overlap aperture 230 of the polymer layer 214 of FIG. 2C is substantially reduced in size. As a result, fewer high frequency electromagnetic fields 126 from the center conductor 202 exit the example coaxial cable 200 through the overlap aperture 230 than exit the prior art coaxial cable 100 through overlap aperture 130 (compare FIGS. 1D and 2C).

This reduction in size or elimination of overlap apertures increases the shielding effectiveness of the overlapping edges portions 220 and 224 of the tape 200, which increases the uniformity of the shielding of interfering high frequency electromagnetic fields in the coaxial cable 200.

It is understood that the benefits of a reduction in size or elimination of overlap apertures noted herein may be achieved with alternative configurations of the tape 206. For example, the thickness of only the first edge portion 220 need be less than the thickness of the interior portion 222. As such, the thickness of the first edge portion 220 may or may not be equal to about the thickness of the second edge portion 224. Moreover, the thicknesses of the edge portions 220 and 224 may each be greater than or less than the respective thickness disclosed in FIGS. 2A-2E.

With reference again to FIG. 2A, the braid 208 surrounds the tape 206, and generally serves to minimize the ingress and egress of electromagnetic fields to/from the center conductor 202. The braid 208 can be formed, for example, from interwoven, fine gauge aluminum or copper wires, such as 34 American wire gauge (AWG) wires. Although the braid wires of the braid 208 are depicted as single rectangular wires in FIG. 2A, each rectangular wire actually represents several round 34 AWG wires. It is understood, however, that the discussion herein of braid is not limited to braid formed from any particular type or size of wire and/or number of wires.

With continuing reference to FIG. 2A, the jacket 210 surrounds the braid 208, and generally serves to protect the internal components of the coaxial cable 200 from external contaminants, such as dust, moisture, and oils, as well as wear and tear over time, for example. The jacket 210 can be formed from materials such as, but not limited to, polyethylene (PE), high-density polyethylene (HDPE), low-density polyethylene (LDPE), or linear low-density polyethylene (LLDPE), foamed PE, polyvinyl chloride (PVC), or polyurethane (PU), or some combination thereof.

II. Second Example Coaxial Cable

Figure 3A:
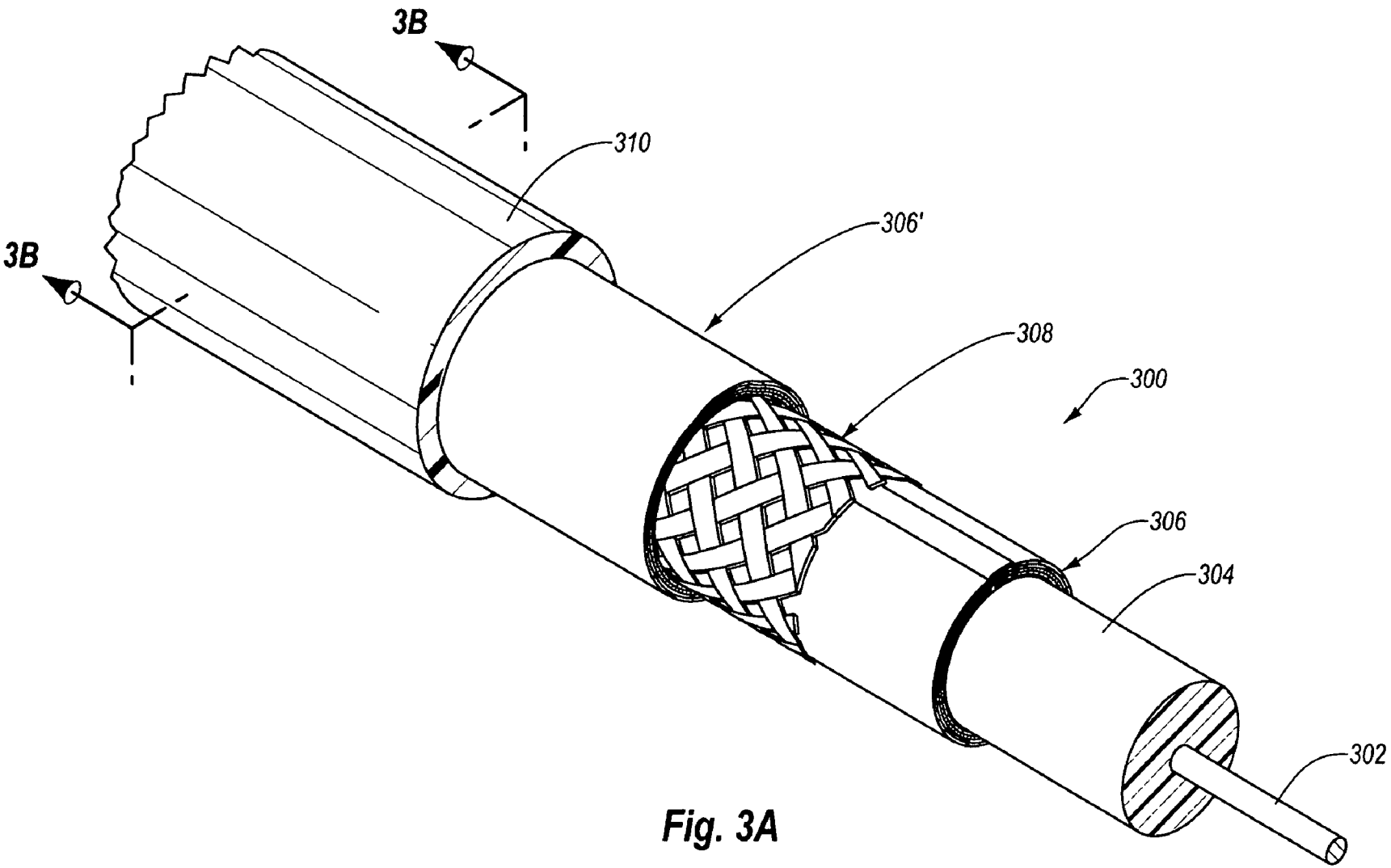
FIG. 3A is a perspective view of a portion of a second example coaxial cable with two example compressed tape layers, the perspective view having portions of each layer of the second example coaxial cable cut away.
Figure 3B:
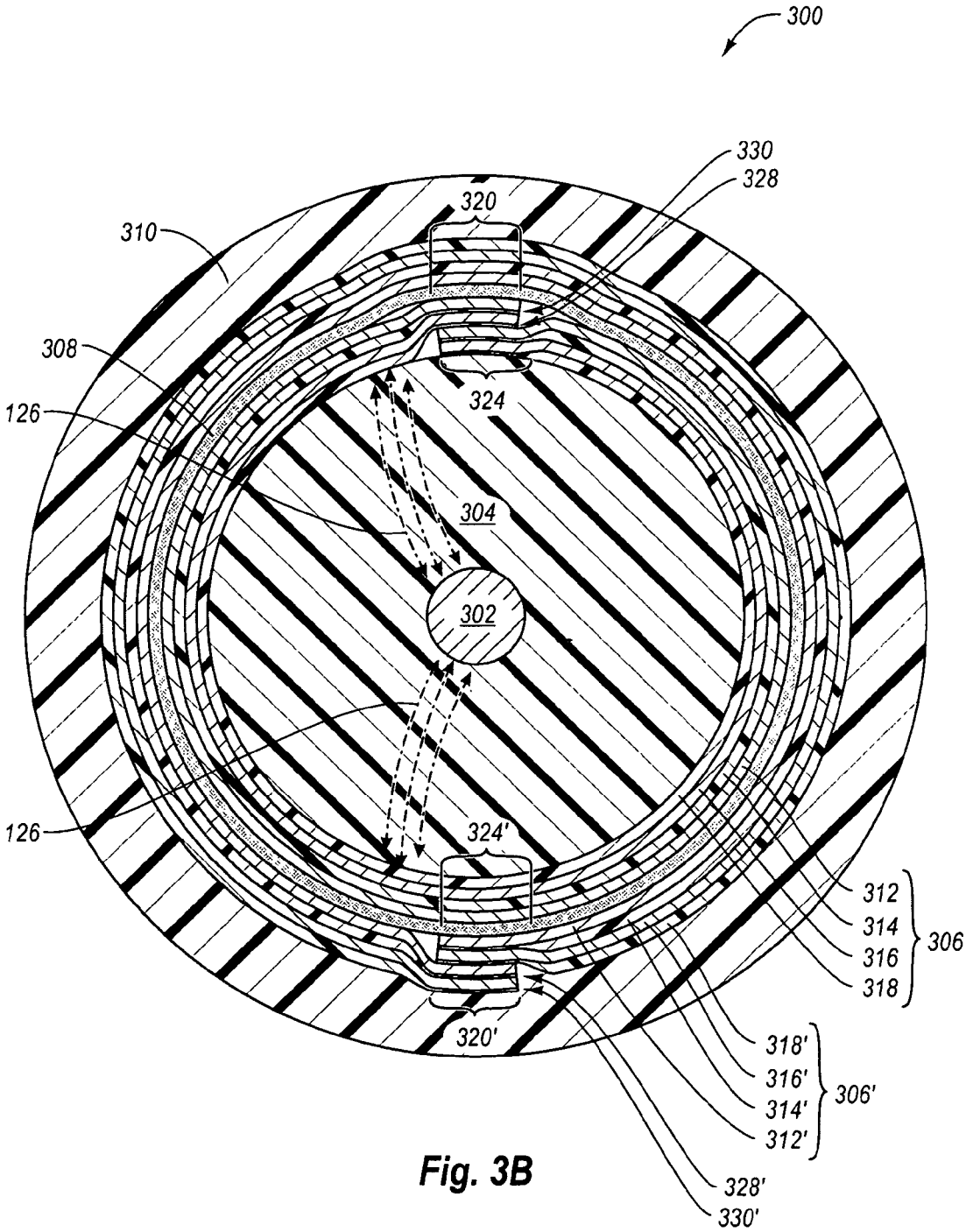
FIG. 3B is a cross-sectional view of the second example coaxial cable of FIG. 3A.

With reference now to FIGS. 3A and 3B, a second example coaxial cable 300 is disclosed. The example coaxial cable 300 generally includes a center conductor 302 surrounded by a dielectric 304, a first tape 306 wrapped longitudinally around the dielectric 304, a braid 308 surrounding the tape 306, a second tape 306' surrounding the braid 308, and a jacket 310 surrounding the second tape 306'. The center conductor 302, dielectric 304, braid 308, and jacket 310 are each substantially identical in composition and function to the center conductor 202, dielectric 204, braid 208, and jacket 210 of FIG. 2A-2C, respectively, although the size and relative positions of these layers can vary between the coaxial cables 200 and 300. In addition, each of the tapes 306 and 306' is substantially identical in composition and function to the tape 206 of FIGS. 2A-2E, although the sizes and relative positions of these layers can also vary between the coaxial cables 200 and 300. Further, the layers 312-318 and 312'-318' are each substantially identical in composition and function to the layers 212-218, respectively. However, the layers of the tape 306' are reversed as compared to the layers of the tape 306 such that the polymer bonding agent layer 318' is immediately adjacent to the jacket 310. This placement of the polymer bonding agent layer 318' immediately adjacent to the jacket 310 serves to provide a secure bond between the tape 306' and the jacket 310.

As the tape 306 is longitudinally wrapped around the longitudinal direction of the dielectric 304, the first edge portion 320 overlaps with the second edge portion 324. The compression of the polymer layer 314 and the polymer bonding agent layer 318 in the edge portions 320 and 324 reduces the size of, or eliminates entirely, typical overlap apertures in the tape 306.

In particular, the overlap aperture 328 of the polymer bonding agent layer 318 and the overlap aperture 330 of the polymer layer 314 are substantially reduced in size as compared to the prior art overlap apertures 128 and 130 of FIG. 1D, respectively. As a result, fewer high frequency electromagnetic fields 126 from the center conductor 302 exit the example coaxial cable 300 through the overlap apertures 328 and 330 than exit the prior art coaxial cable 100 through overlap apertures 128 and 130. Similarly, the extra layer of shielding provided by the second tape 306', in combination with the reduced sizes of the overlap aperture 328' of the polymer bonding agent layer 318' and of the overlap aperture 330' of the polymer layer 314', also results in fewer high frequency electromagnetic fields 126 from the center conductor 302 exit the example coaxial cable 300 through the overlap apertures 328' and 330'.

This reduction in size or elimination of overlap apertures increases the shielding effectiveness of the overlapping edge portions 320 and 324 of the tape 306 and the overlapping edge portions 320' and 324' of the tape 306', which increases the uniformity of the shielding of interfering high frequency electromagnetic fields in the coaxial cable 300.

III. Third Example Coaxial Cable

Figure 4A:
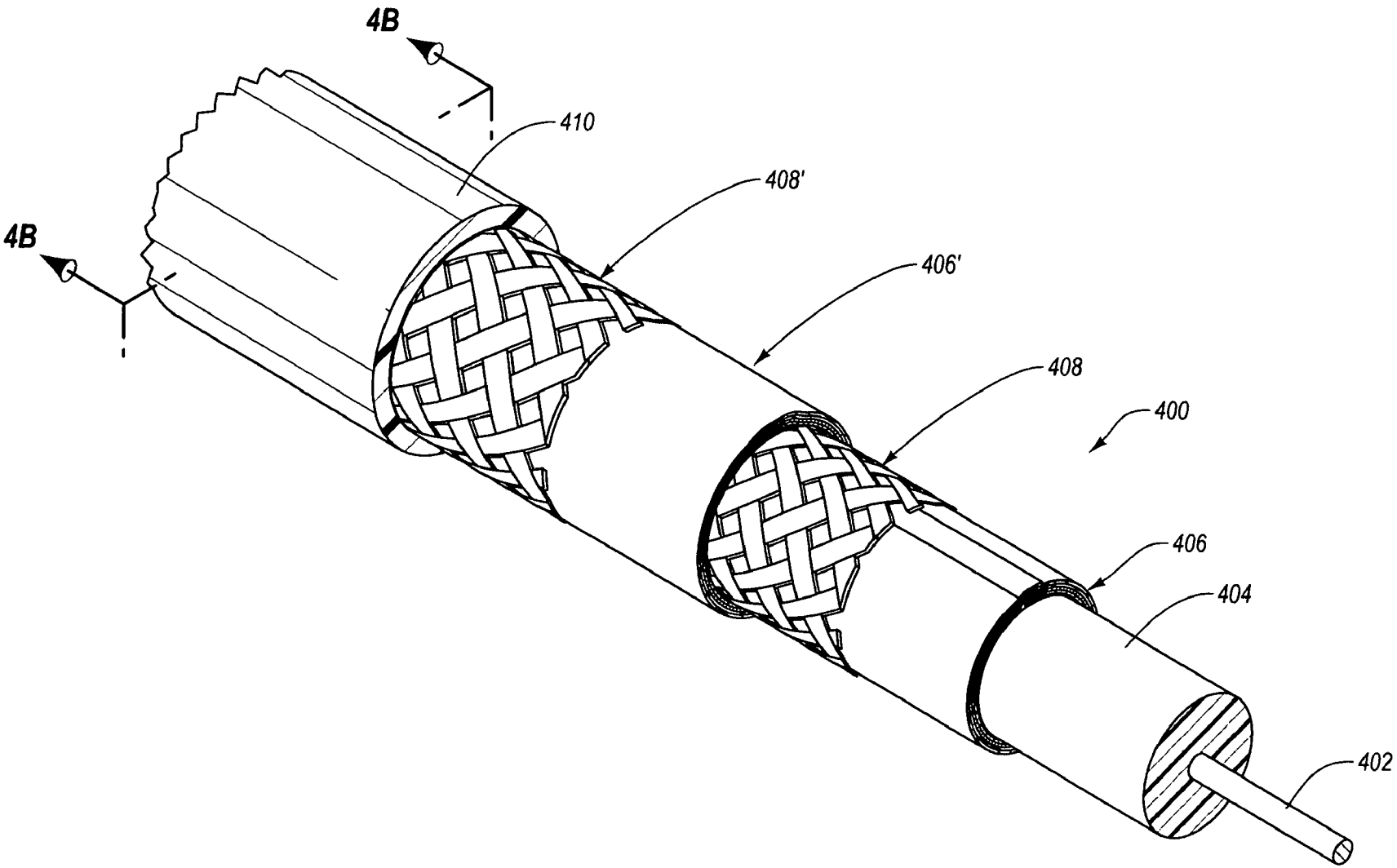
FIG. 4A is a perspective view of a portion of a third example coaxial cable with two example compressed tape layers, the perspective view having portions of each layer of the third example coaxial cable cut away.
Figure 4B:
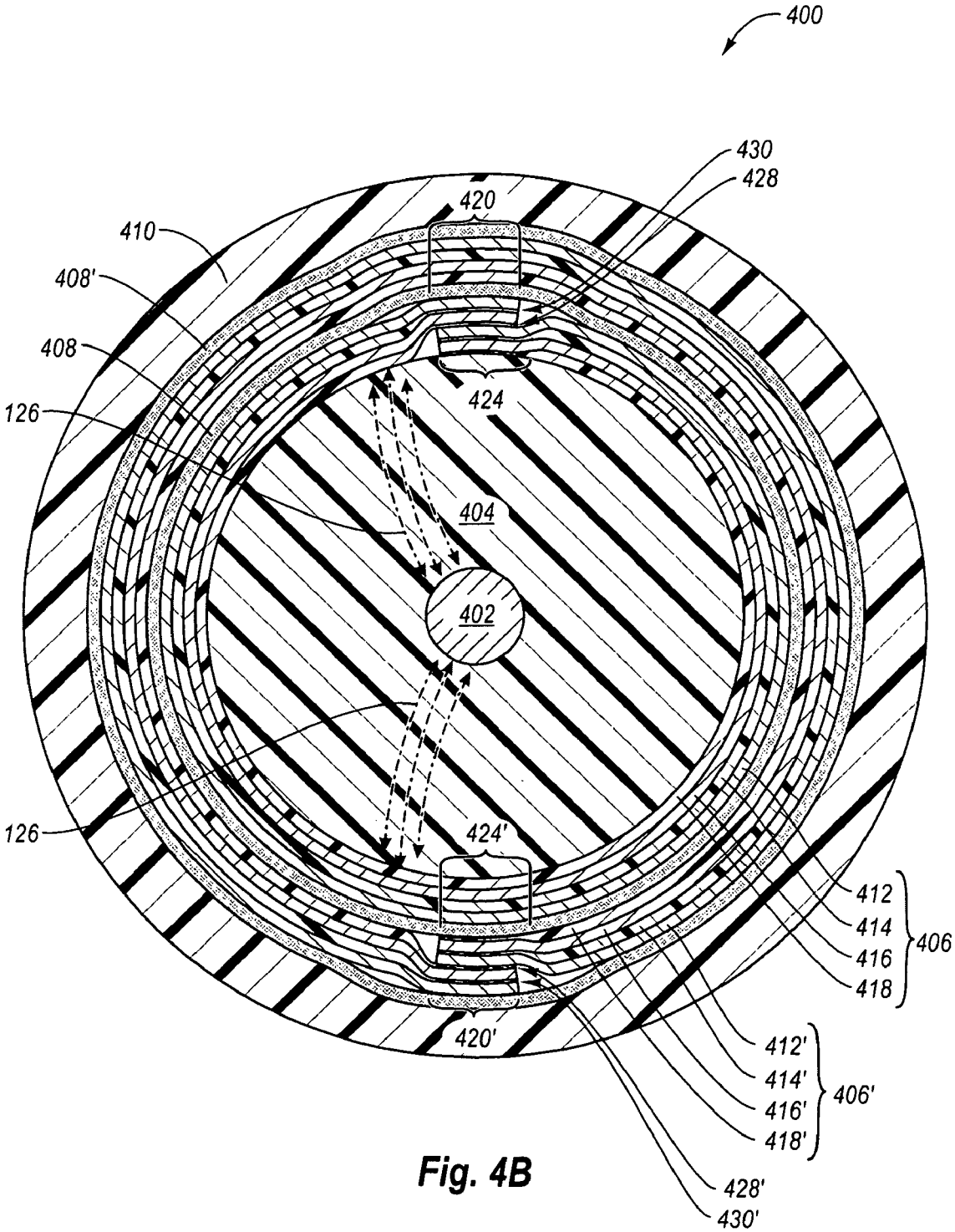
FIG. 4B is a cross-sectional view of the third example coaxial cable of FIG. 4A.

With reference now to FIGS. 4A and 4B, a third example coaxial cable 400 is disclosed. The example coaxial cable 400 generally includes a center conductor 402 surrounded by a dielectric 404, a first tape 406 wrapped longitudinally around the dielectric 404, a braid 408 surrounding the tape 406, a second tape 406' surrounding the braid 408, a second braid 408' surrounding the second tape 406', and a jacket 410 surrounding the second braid 408'. The center conductor 402, dielectric 404, and jacket 410 are each substantially identical in composition and function to the center conductor 202, dielectric 204, and jacket 210 of FIG. 2A-2C, respectively, although the size and relative positions of these layers can vary between the coaxial cables 200 and 400. In addition, each of the tapes 406 and 406' is substantially identical in composition and function to the tape 206 of FIGS. 2A-2E, although the sizes and relative positions of these layers can also vary between the coaxial cables 200 and 400. Similarly, the layers 412-418 and 412'-418' are each substantially identical in composition and function to the layers 212-218, respectively. Further, each of the braids 408 and 408' is substantially identical in composition and function to the braid 208 of FIGS. 2A-2C, although the sizes and relative positions of these layers can also vary between the coaxial cables 200 and 400.

The addition of the second layer of tape 406' and braid 408' in the example coaxial cable 400 increases the shielding of interfering high and low frequency electromagnetic fields, respectively, in the example coaxial cable 400.

IV. Example Messengered Coaxial Cable

Figure 5A:
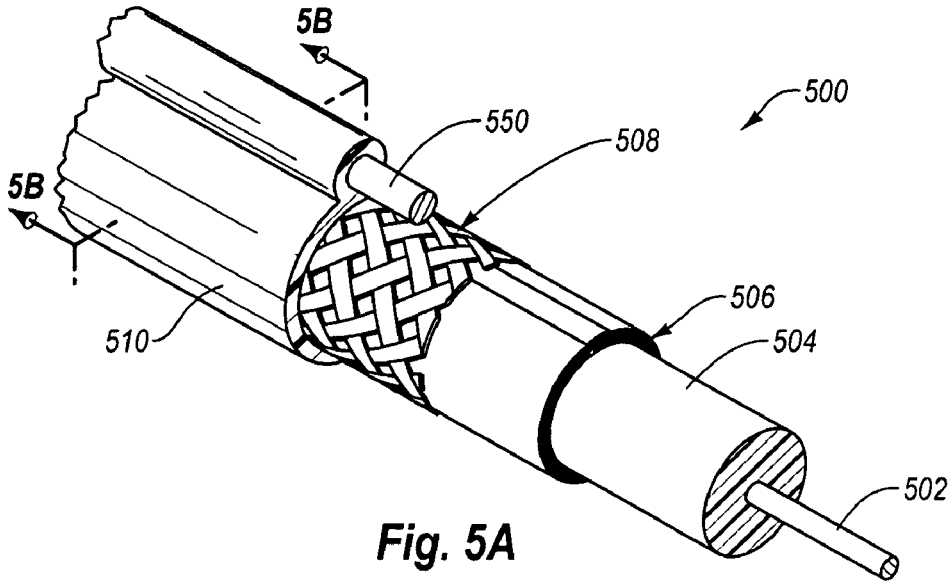
FIG. 5A is a perspective view of a portion of an example messengered coaxial cable with an example compressed tape layer, the perspective view having portions of each layer of the example messengered coaxial cable cut away.
Figure 5B:
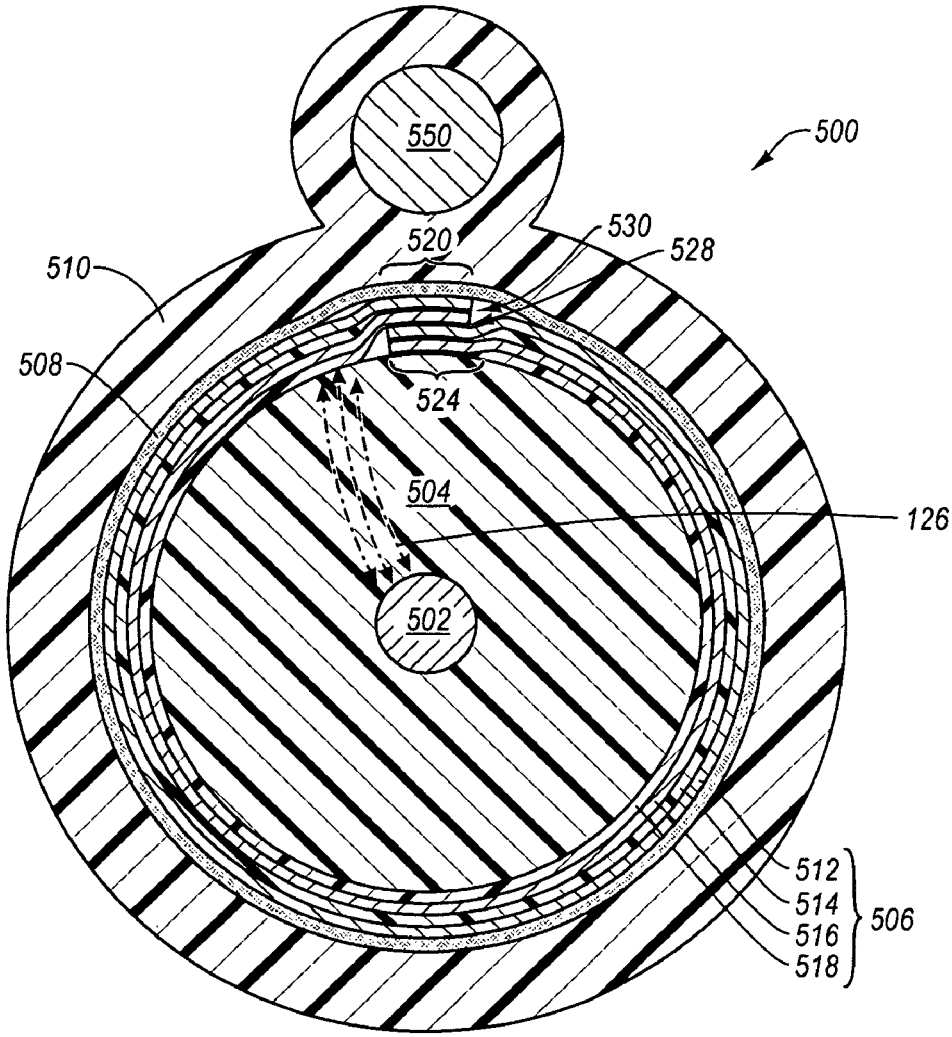
FIG. 5B is a cross-sectional view of the example messengered coaxial cable of FIG. 5A.

With reference now to FIGS. 5A and 5B, an example messengered coaxial cable 500 is disclosed. The example messengered coaxial cable 500 generally includes a center conductor 502 surrounded by a dielectric 504, a tape 506 wrapped longitudinally around the dielectric 504, a braid 508 surrounding the tape 506, a messenger wire 550 running parallel to the center conductor 502, and a jacket 510 surrounding both the braid 508 and the messenger wire 500. The center conductor 502, dielectric 504, tape 506, and braid 508 are each substantially identical in composition and function to the center conductor 202, dielectric 204, tape 206, and braid 208 of FIG. 2A-2C, respectively. Further, the layers 512-518 are each substantially identical in composition and function to the layers 212-218, respectively. In addition, the jacket 510 is substantially identical in composition to the jacket 210 of FIGS. 2A-2C, except that the jacket 510 further surrounds both the braid 508 as well as the messenger wire 550, thereby protecting the internal components of the messengered coaxial cable 500 as well as securing the messenger wire 550 to the other internal components of the messengered coaxial cable 500.

The messenger wire 550 generally serves to support the messengered coaxial cable 500 in situations where the messengered coaxial cable 500 aerially spans long distances, such as 75 feet or more. The messenger wire 550 can be tied off by partially separating the messenger wire 550 from the messengered coaxial cable 500, wrapping the messenger wire 550 around a hook or other anchor on a structure, wrapping the messenger wire 550 around itself one or more times, and finally wrapping the messenger wire 550 around the messengered coaxial cable 500 one or more times to prevent further cable-messenger separation.

V. Example Method for Manufacturing a Coaxial Cable

Figure 6:
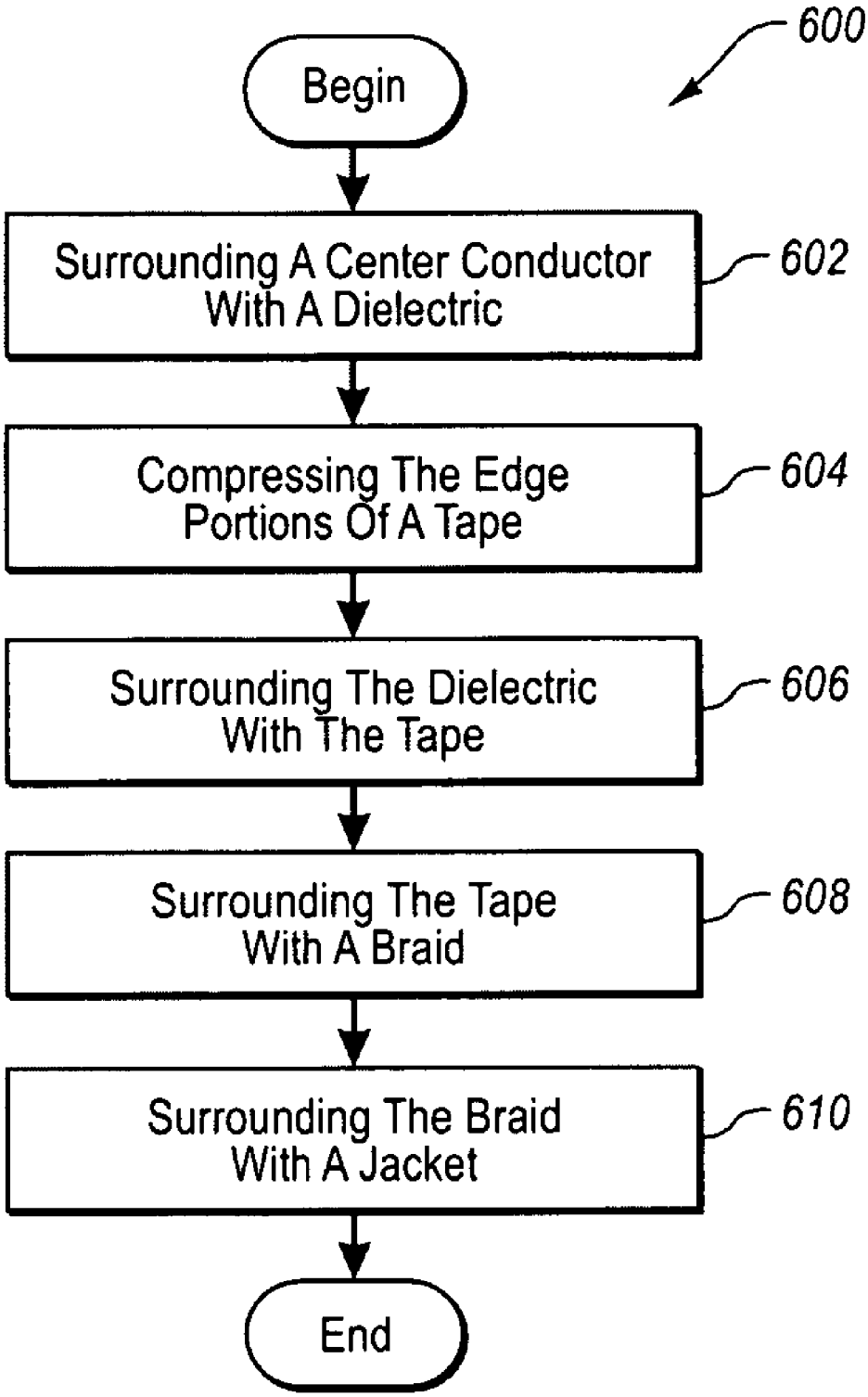
FIG. 6 is a flowchart of an example method for manufacturing the example coaxial cable of FIG. 2A.

With reference again to FIGS. 2A-2E, and with reference now also to FIG. 6, an example method 600 for manufacturing the example coaxial cable 200 is disclosed.

At step 602, the center conductor 202 is surrounded with the dielectric 204. For example, the center conductor 202 can be fed through a first extruder where a pre-coat of a bonding agent, such as a polymer, is applied. The pre-coated center conductor 200 can then be fed through a second extruder where the dielectric 204 is applied so as to surround the center conductor 202. Alternatively, the step 602 may be omitted altogether where the center conductor 202 has been surrounded with the dielectric 204 prior to the performance of the example method 600.

At step 604, one or both of the edge portions 220 and 224 of the tape 206 is/are compressed. For example, the tape 206 can be passed through a pair of rollers in order to compress the dielectric polymer layer 214 and the dielectric polymer bonding agent layer 218 in edge portions 220 and 224 such that the thickness of each of the edge portions 220 and 224 is less than the thickness of the interior portion 222. In addition the tape 206 can be heated in order to soften the dielectric polymer layer 214 and the dielectric polymer bonding agent layer 218 of the tape 206 prior to the compression of the edge portions 220 and 224. This heating of the tape 206 can be accomplished by passing the tape 206 through a heating element in order to soften the dielectric polymer layer 214 and the dielectric polymer bonding agent layer 218. This heating element may be separate from the rollers or may be integrated into the rollers thus making the rollers heated rollers. As such, the heating of the tape 206 can be accomplished by passing the tape 206 through a pair of heated rollers in order to both soften and compress the dielectric polymer layer 214 and the dielectric polymer bonding agent layer 218. In some example embodiments, the tape 206 is heated to a temperature between about 85° C. and about 95° C. As discussed above, the step 604 may alternatively include the compression of only one of the edge portions, such as the edge portion 220.

Next, at step 606, the dielectric 204 is surrounded with the tape 206. For example, the dielectric 204 and the components it surrounds can be fed through a wrapping operation that wraps a layer of tape 206 around the dielectric 204. The tape 206 is wrapped helically or longitudinally around the dielectric 204 such that the first edge portion 220 overlaps with the second edge portion 224.

Next, at step 608, the tape 206 is surrounded with the braid 208. For example, the tape 206 and the components it surrounds can be fed through a braiding operation that braids, weaves, or wraps the braid 208 around the tape 206. It is understood that multiple layers of tape and/or multiple layers of braid shielding can be applied during the manufacturing of the coaxial cable 200 in order to increase the shielding of interfering high and low frequency electromagnetic fields, such as in the example coaxial cables 300 and 400 disclosed in connection with FIGS. 3A-3B and 4A-4B, respectively. Alternatively, the step 608 may be omitted altogether when the coaxial cable 200 does not include a braid 208. It is also understood that steps 604, 606, and 608 may all occur substantially simultaneously during a braiding operation.

Finally, at step 610, the braid 208 is surrounded with the jacket 210. For example, the braid 208 and the components it surrounds can be fed through a third extruder where the jacket 210 is applied so as to surround the braid 208. In some example embodiments, the heat used during the application of the jacket 210 activates the polymer bonding agent layer 218 of the tape 206, which serves to provide a secure bond between the dielectric 204 and the tape 206. Similarly, it is understood that the heat used during the application of the jacket 310 to the coaxial cable 300 can activate the polymer bonding agent layer 318 of the tape 306 as well as the polymer bonding agent layer 318' of the tape 306'. This activation of both polymer bonding agent layers 318 and 318' serves to provide a secure bond between the dielectric 304 and the tape 306 and a secure bond between the tape 306' and the jacket 310. It is further understood that the jacket 210 can further surround a messenger wire during the step 610, such as in the example messengered coaxial cable 500 disclosed in connection with FIGS. 5A-5B. Subsequent to the step 610, the coaxial cable 200 can be subjected to electrical and mechanical test to ensure that, once installed, the coaxial cable 200 will perform according to industry requirements.

Thus, the example method 600 can be employed to form the example coaxial cable 200. As disclosed elsewhere herein, the relative thinness of the edge portions 220 and 224 as compared to the interior portion 222 of the tape 206 reduces the size of, or eliminates entirely, overlap apertures on the face of the first edge portion 220. This reduction in size or elimination of overlap aperture increases the shielding effectiveness of the portions of the tape 206 at or near the overlap, which results in an increase in the uniformity of the shielding of interfering high frequency electromagnetic fields in the coaxial cable 200.

Figure 1E:
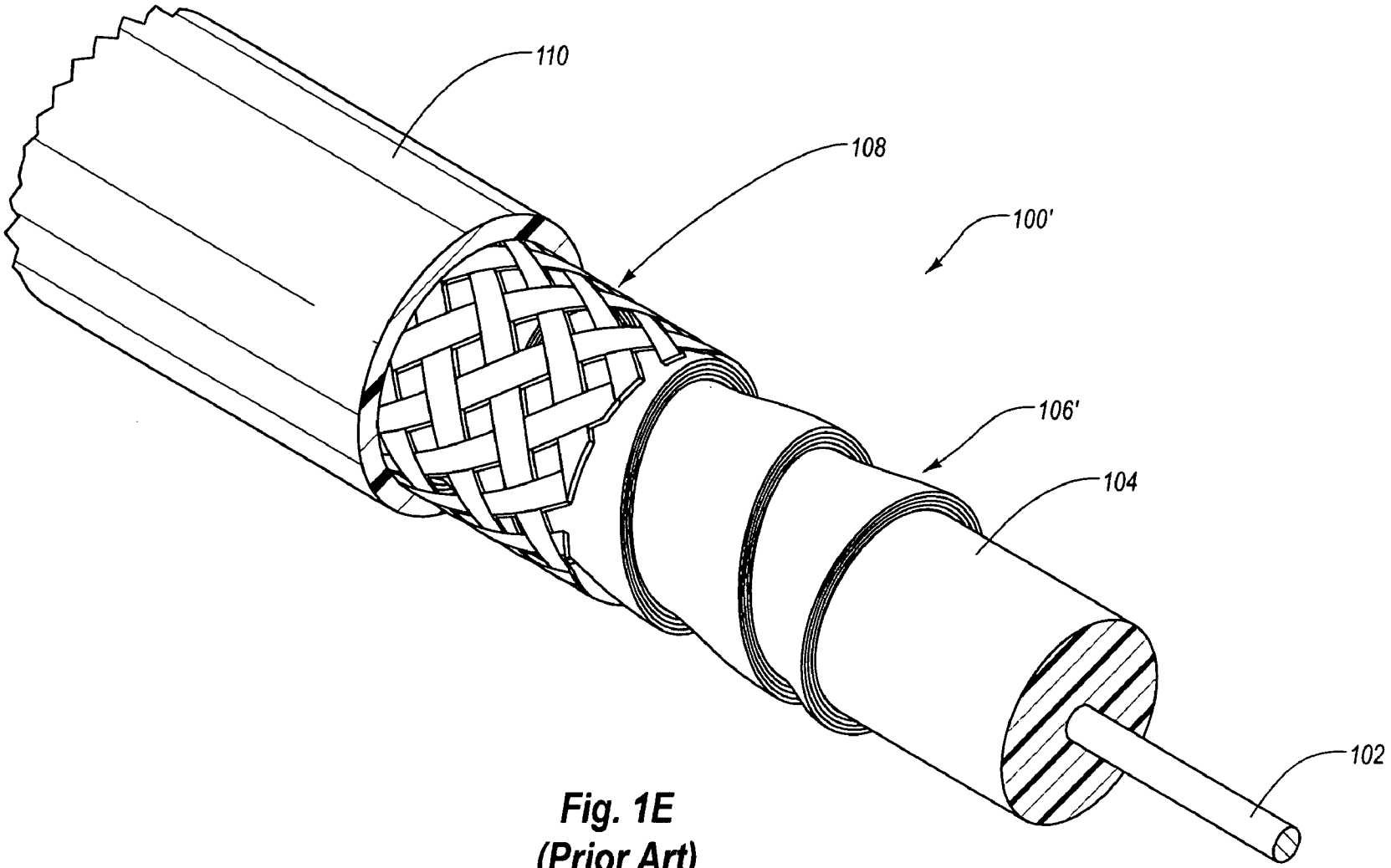
Fig. 1E (Prior Art)
FIG. 1E is a perspective view of a portion of another prior art coaxial cable, the perspective view having portions of each layer of the prior art coaxial cable cut away.

Although the example coaxial cable 200 is configured as a standard coaxial cable, it is understood that other cable configurations may likewise benefit from the tape 206 disclosed herein. For example, flooded coaxial cables can be configured to include a tape with compressed overlapping edge portions. In addition, coaxial cables with helically wrapped tape, such as the coaxial cable 100' disclosed in FIG. 1E, can likewise be configured to have compressed overlapping edge portions similar to the edge portions 220 and 224 of the tape 206. These compressed edge portions can reduce the size of, or eliminate entirely, overlap apertures that run in a helical course along the face of the top portion of the helically wrapped tape, such as the helically wrapped tape 106' of FIG. 1E. This reduction or elimination of the overlap apertures will increase the shielding effectiveness of the helically wrapped tape 106' at or near the overlap, and will further result in an increase in the uniformity of the shielding of interfering high frequency electromagnetic fields in the coaxial cable 100'.

The example embodiments disclosed herein may be embodied in other specific forms. The example embodiments disclosed herein are to be considered in all respects only as illustrative and not restrictive.

What is claimed is:

1. A coaxial cable comprising:

a center conductor surrounded by a dielectric;

a tape defining first and second edge portions that each borders an interior portion, a thickness of the first edge portion being less than a thickness of the interior portion, the tape being wrapped around the dielectric such that the first edge portion overlaps with the second edge portion, wherein the tape comprises an aluminum layer and a polymer layer adjacent to the aluminum layer, and wherein a thickness of the polymer layer in the first edge portion is less than a thickness of the polymer layer in the interior portion; and a jacket surrounding the tape.

2. The coaxial cable as recited in claim 1, wherein a thickness of the second edge portion is less than the thickness of the interior portion.

3. The coaxial cable as recited in claim 1, wherein the tape further comprises a polymer bonding agent layer adjacent to the polymer layer.

4. The coaxial cable as recited in claim 1, wherein the tape further comprises a second aluminum layer adjacent to the polymer layer.

5. The coaxial cable as recited in claim 4, wherein the tape further comprises a polymer bonding agent layer adjacent to the second aluminum layer.

6. The coaxial cable as recited in claim 5, wherein a thickness of the polymer bonding agent layer in the first edge portion is less than a thickness of the polymer bonding agent layer in the interior portion.

7. The coaxial cable as recited in claim 1, further comprising a braid that surrounds the tape and that is surrounded by the jacket.

8. The coaxial cable as recited in claim 1, wherein the tape is longitudinally wrapped around the dielectric.

9. A coaxial cable comprising:

a center conductor;

a dielectric surrounding the center conductor;

a tape surrounding the dielectric, the tape defining first and second edge portions that each borders an interior portion, a thickness of the first edge portion being less than a thickness of the interior portion, the tape being wrapped around the dielectric such that the first edge portion overlaps with the second edge portion, wherein the tape comprises one or more conductive layers and one or more nonconductive layers, and wherein the thickness of the nonconductive layer in the first edge portion is less than the thickness of the nonconductive layer in the interior portion;

a braid surrounding the tape; and jacket surrounding the braid.

10. The coaxial cable as recited in claim 9, wherein a thickness of the second edge portion is less than the thickness of the interior portion.

11. The coaxial cable as recited in claim 9, further comprising a messenger wire running parallel to the center conductor and surrounded by the jacket.

12. A coaxial cable comprising:

a center conductor, a dielectric surrounding the center conductor;

a first tape surrounding the dielectric, the first tape defining first and second edge portions that each borders an interior portion, a thickness of the first edge portion being less than a thickness of the interior portion, the first tape being wrapped around the dielectric such that the first edge portion overlaps with the second edge portion, wherein the first tape comprises an aluminum layer and a polymer layer adjacent to the aluminum layer, wherein a thickness of the polymer layer in the first edge portion is less than a thickness of the polymer layer in the interior portion;

a braid surrounding the first tape;

a second tape surrounding the braid; and a jacket surrounding the second tape.

13. The coaxial cable as recited in claim 12, wherein a thickness of the second edge portion is less than the thickness of the interior portion.

14. The coaxial cable as recited in claim 12, wherein the second tape defines third and fourth edge portions that each borders an interior portion of the second tape, a thickness of the third edge portion being less than a thickness of the interior portion of the second tape, the second tape being wrapped around the braid such that the third edge portion overlaps with the fourth edge portion.

15. The coaxial cable as recited in claim 12, further comprising a second braid surrounding the second tape and surrounded by the jacket.

16. The coaxial cable as recited in claim 15, further comprising a messenger wire running parallel to the center conductor and surrounded by the jacket.

* * * * *